US006788265B2

(12) United States Patent
Kuramoto

(10) Patent No.: US 6,788,265 B2
(45) Date of Patent: Sep. 7, 2004

(54) ANTENNA ELEMENT

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 3 days.

(21) Appl. No.: 10/277,924

(22) Filed: Oct. 23, 2002

(65) Prior Publication Data

US 2003/0076269 A1 Apr. 24, 2003

(30) Foreign Application Priority Data

Oct. 24, 2001 (JP) ..... 2001-325856

(51) Int. Cl.[7] ..... H01Q 9/00
(52) U.S. Cl. ..... 343/752; 343/700 MS
(58) Field of Search ..... 343/700 MS, 749, 343/750, 752, 829, 830, 846, 848

(56) References Cited

U.S. PATENT DOCUMENTS 5,181,044 A * 1/1993 Matsumoto et al. ..... 343/752
6,188,366 B1 * 2/2001 Yamamoto et al. ..... 343/722

OTHER PUBLICATIONS

Yasuto Mushiake, "Antennas and Radio Propagation", *Corona Inc.*, pp. 69–70.

* cited by examiner

*Primary Examiner*—Shih-Chao Chen
(74) *Attorney, Agent, or Firm*—Foley & Lardner LLP

(57) ABSTRACT

A monopole antenna element being low in price and usable in a wide band, for which fine adjustment of input impedance and resonance frequency is easily carried out. The monopole antenna in accordance with the present invention comprises a top plate having an elliptical shape, a printed board, and a monopole that is joined with the center of the top plate at one end. The top plate may assume a shape other than ellipse when being symmetrical with respect to two orthogonal axes passing through the center of the area of the top plate, in which the lengths of the axes are different from each other. Besides, the top plate may include a cutaway(s) to reduce field emissions having horizontal components. In addition, the top plate may be provided with a fold along with an axis passing through the center of the area of the top plate so that adjustments for input impedance, etc. of the antenna can be carried out. On the other hand, the monopole may have a bend part for adjusting input impedance, etc. of the antenna.

11 Claims, 8 Drawing Sheets

ANTENNA ELEMENT

FIELD OF THE INVENTION

The present invention relates to a top-loading monopole antenna element and, more particularly, to the configuration of a monopole antenna element being low in price and usable in a wide band, for which fine adjustment of input impedance and resonance frequency is easily carried out.

BACKGROUND OF THE INVENTION

Computer networking has been advancing rapidly along with the widespread use of computers such as PCs. Based on this, attention is currently focused on wireless LAN systems that are capable of establishing computer networks without links between computers by a network cable or the like.

Such wireless LAN system includes an antenna element (hereinafter simply referred to as antenna) for sending/receiving data exchanged between computers via radio waves. The antenna is mainly comprised of a circular plate made of conductors such as metals, a printed board including a dielectric board, and a conductive monopole that is joined with the center of the circular plate at one end and with the printed board at the other end.

In the following, a description will be given of the configuration of a conventional antenna element. FIG. 1 is a perspective view showing the configuration of a conventional antenna element which, for example, sends/receives data using a 2.4 GHz or 5 GHz band.

The antenna shown in FIG. 1 comprises a circular plate 901 made of conductors such as metals, a monopole 902 that is also made of conductors such as metals, and a printed board 903. The top of the monopole 902 is joined with the center of the circular plate 901.

The printed board 903 includes a conductive ground board 904 as an upper layer and a dielectric board 905 as a lower layer. Further, there is arranged a microstrip line 906 made of a conductor under the dielectric board 905. The ground board 904 is provided with a pattern clearance hole 907. The lower end of the monopole 902 extends through the pattern clearance hole 907 without touching the ground board 904, and is joined with the microstrip line 906 by soldering or the like at a power supply point 908.

Next, a description will be given of the principle of electrical operation of the conventional antenna. FIGS. 2(*a*) and 2(*b*) are diagrams showing the current distribution of the conventional antenna. Referring to FIG. 2(*a*), a current $i_0$ runs through the monopole 902. Meanwhile, there are currents $i_1$ to $i_4$ flowing in the circular plate 901. As can be seen in FIG. 2(*a*), by the use of the circular plate 901, the original current $i_0$ is distributed over the circular plate 901. Accordingly, the antenna can be shortened or lowered.

The currents in the circular plate 901, which are represented by the four currents $i_1$ to $i_4$ as a pattern in FIG. 2(*a*), flow in all directions from the center of the circular plate 901. Considering field emissions from these currents, it is readily understood that the current $i_0$ generates vertical polarized waves being parallel to the current $i_0$, which are uniformly radiated in a horizontal plane. Meanwhile, electromagnetic radiations generated from the currents $i_1$ to $i_4$ vectorially counteract each other. Thus, it turns out that there is no field radiation having horizontal components.

On the other hand, considering the range of frequencies, the antenna almost invariably resonates at a wavelength resulting from the current running through the length of $l_0$ and $l_1$ since the radius of the circular plate 901, where the currents $i_1$ to $i_4$ flow, is invariant. Thus, the conventional antenna exhibits a bandwidth capability equal to or lower than that of monopole antennas having no plate.

FIG. 3 is a graph showing the return loss of the conventional antenna by actual measurement. The antenna has the configuration illustrated in FIG. 1. The diameter of the circular plate is approximately 6 mm. The distance between the circular plate and the upper surface of the printed board, that is, the length of the monopole except for the part inserted in the printed board is 5.5 mm. In addition, the microstrip line is arbitrarily provided with stubs thereon to carry out adjustment of return loss characteristics. As can be seen in FIG. 3, the conventional antenna is operational in a bandwidth of 280 MHz, which constitutes about 5.1% of the frequency spectrum.

In the communication facilities of various nations, frequency assignments for the wireless LAN system are tend to expand because of the convenience or usability of the system. Accordingly, there is need for techniques to produce wideband antennas used in the wireless LAN system.

Additionally, with the popularization of the wireless LAN system, it becomes an important issue for manufacturers to reduce the cost of hardware. Therefore, considerable importance is attached to ideas on the antenna structure for realizing inexpensive antennas.

Besides, adjustments of analog RF characteristics are carried out by necessity at the production inspection section of each manufacturer. Should the adjustments be accomplished in antennas, the direct first run rate (yield ratio) can be improved. As a result, the total cost of the antennas can be reduced.

However, in the configuration of the above-mentioned conventional antenna, a current flows the uniform length of the monopole and the radius of the circular plate. Therefore, the antenna does not resonate at a number of wavelengths.

In addition, while the combination of the monopole and circular plate is created by cutting off them from single piece of substance, by molding, or by soldering after manufacturing them separately, any of the methods entails relatively high manufacturing cost. Moreover, since it is difficult to carry out fine adjustment for antenna part after manufacturing, the direct first run rate (yield ratio) cannot be improved effectively, which precludes the supplies of low cost antennas.

For example, there is described a top-loading antenna in Yasuto Mushiake,"Antennas and Radio Propagation," pp. 69–70 (Corona Inc.). This type of antenna has a load such as a circular ring at its top. Although the antenna was originally devised for the purpose of keeping an elevation angle of radiation small or reducing high-angle radiation, it also had the effect of shortening or lowering the antenna itself Since the antenna had been used in medium waves with low frequency, the antenna was chiefly aimed at improving the elevation angle of radiation and shortening or lowering its height. Consequently, the uniformity of directivity in a horizontal plane (rotational symmetry), cross-polarized wave characteristics, wideband applicability, and easy adjustment were not taken into consideration.

SUMMARY OF THE INVENTION

It is therefore an object of the present invention to provide an antenna element being usable in a wider band as compared to the conventional antennas.

It is another object of the present invention to provide an antenna element which is simple in structure and low in price.

It is yet another object of the present invention to provide an antenna element, for which fine adjustment of input impedance and resonance frequency is easily carried out.

In accordance with the first aspect of the present invention, to achieve the above objects, there is provided an antenna element comprising: a top plate; a printed board; and a monopole that is joined with the top plate at one end and with the printed board at the other end in such a manner as to hold the top plate in a fixed posture toward the printed board; wherein, the top plate is symmetrical with respect to two orthogonal axes which are perpendicular to the thickness of the top plate and passing through the center of the area of the top plate; and the lengths of the axes are different from each other.

In accordance with the second aspect of the present invention, in the first aspect, the top plate has an elliptical shape.

In accordance with the third aspect of the present invention, in the first aspect, the top plate has a shape selected from polygons including rectangle, rhombus, hexagon and dodecagon.

In accordance with the fourth aspect of the present invention, in the third aspect, the angles of the polygon-shaped top plate are all or partly rounded off In accordance with the fifth aspect of the present invention, there is provided an antenna element comprising: a top plate; a printed board; and a monopole that is joined with the top plate at one end and with the printed board at the other end in such a manner as to hold the top plate in a fixed posture toward the printed board; wherein, the top plate is integrally formed with the monopole from a flat plate; the top plate is symmetrical with respect to two orthogonal axes which are perpendicular to the thickness of the top plate and pass through the center of the area of the top plate; the lengths of the axes are different from each other; the top plate and the monopole are formed by means of bending the monopole out of the flat plate; and the monopole-bending creates a cutaway in the flat plate.

In accordance with the sixth aspect of the present invention, in the fifth aspect, another cutaway is provided in the flat plate, and the top plate is substantially symmetrical with respect to the longitudinal axis of the cutaways and an axis running at right angles thereto, which are perpendicular to the thickness of the top plate.

In accordance with the seventh aspect of the present invention, in the fifth or sixth aspect, the cutaways are formed longitudinally or transversely of the top plate.

In accordance with the eighth aspect of the present invention, in the fifth aspect, the top plate has an elliptical shape.

In accordance with the ninth aspect of the present invention, in the fifth aspect, the top plate has a shape selected from polygons including rectangle, rhombus, hexagon and dodecagon.

In accordance with the tenth aspect of the present invention, in the ninth aspect, the angles of the polygon-shaped top plate are all or partly rounded off.

In accordance with the eleventh aspect of the present invention, in one of the first to fifth aspects, the top plate can be bent from a bend axis including a point where one end of the monopole is joined.

In accordance with the twelfth aspect of the present invention, in the eleven aspect, the top plate can be bent into a V-shape or an inverted V-shape.

In accordance with the thirteenth aspect of the present invention, in one of the first, fifth, sixth, seventh and eleventh aspects, the monopole is provided with a bend part which can be bent out of the plane of the monopole to form a recess.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
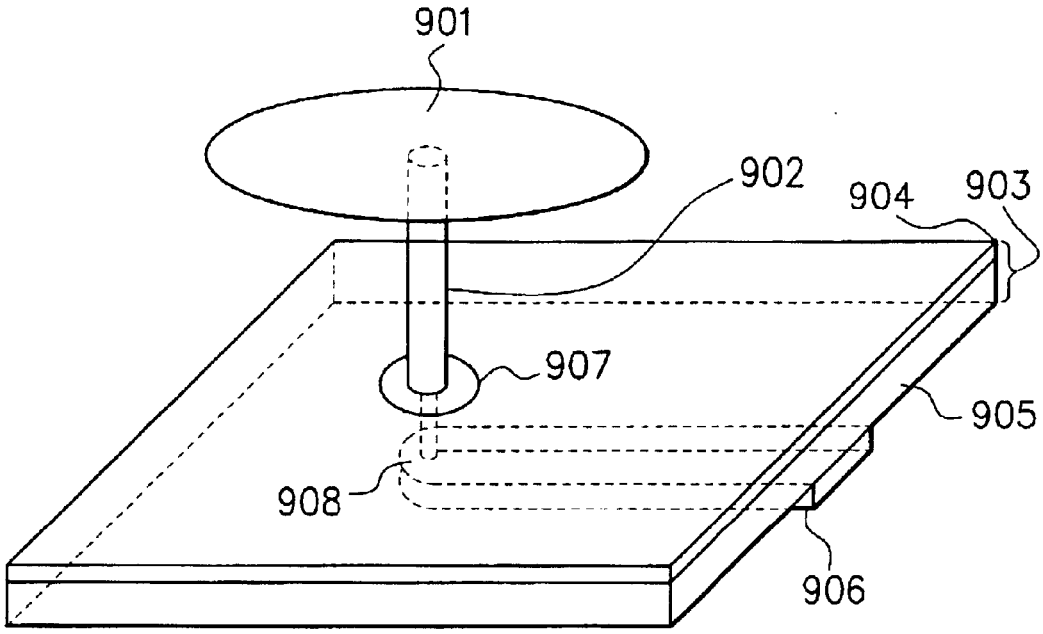
FIG. 1 PRIOR ART
FIG. 1 is a perspective view showing the configuration of a conventional antenna element.
Figure 2A:
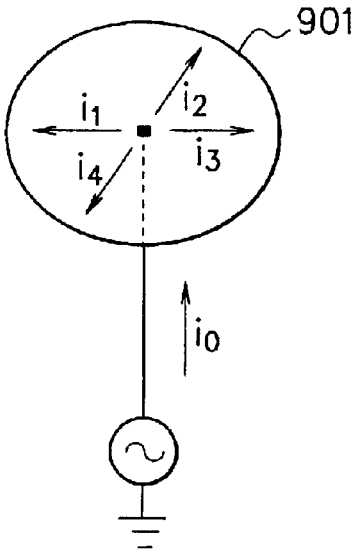
FIG. 2(a) PRIOR ART
FIGS. 2(*a*) and 2(*b*) are diagrams showing the current distribution of the antenna element depicted in FIG. 1.
Figure 2B:
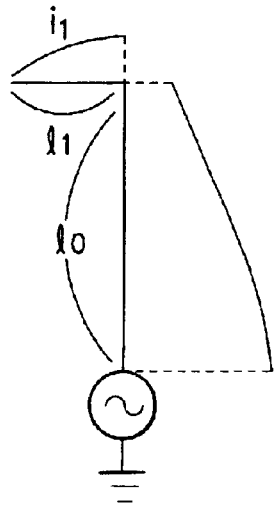
FIG. 2(b) PRIOR ART

Referring now to the drawings, a description of preferred embodiments of the present invention will be given in detail.

Figure 4:
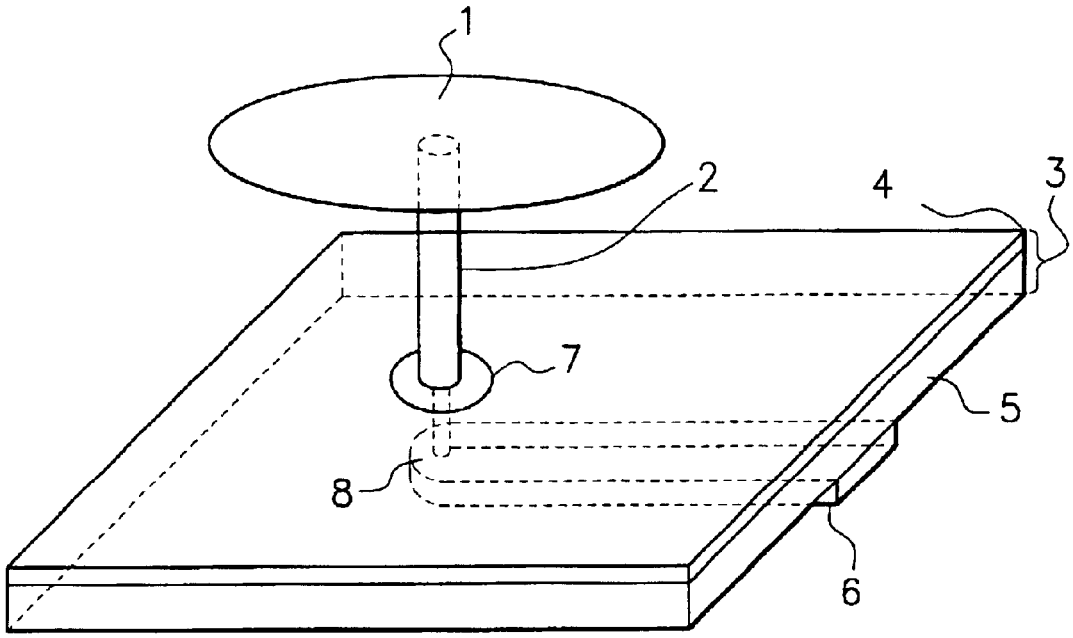
FIG. 4 is a perspective view showing the configuration of an antenna element according to the first embodiment of the present invention.
Figure 5:
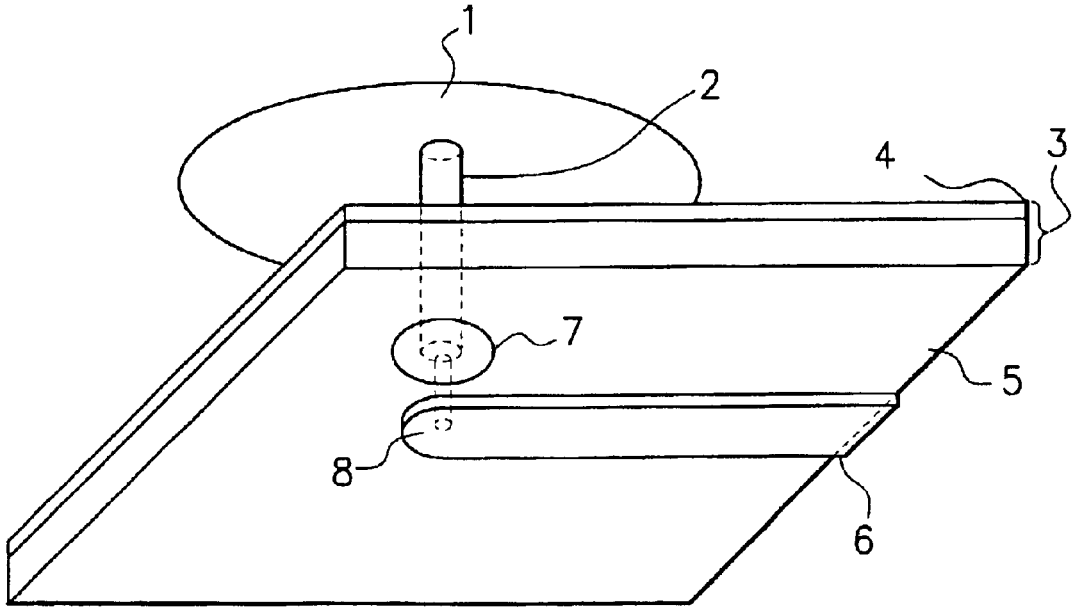
FIG. 5 is another perspective view showing the configuration of the antenna element depicted in FIG. 4.
Figure 6:
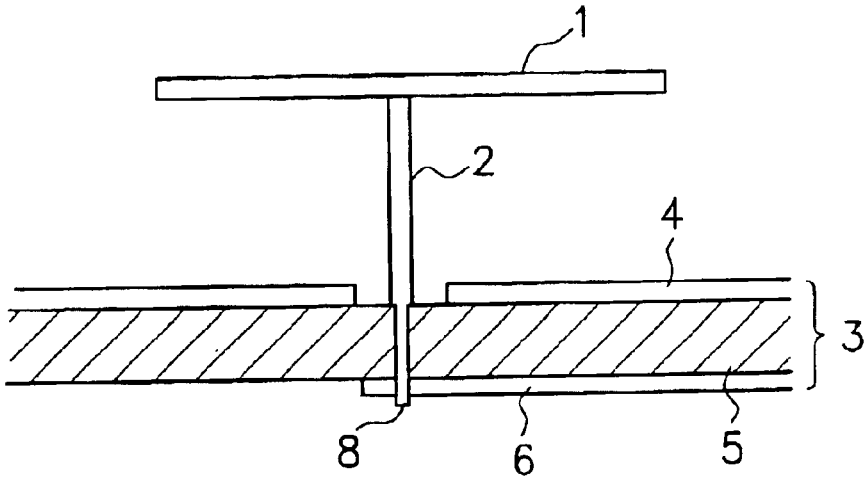
FIG. 6 is a cross sectional view showing the configuration of the antenna element depicted in FIG. 4.

In the following, the configuration of an antenna element according to the present invention will be described. FIG. 4 is a perspective view of an antenna according to the first embodiment of the present invention, taken from a high angle. FIG. 5 is a perspective view of the antenna taken from a low angle. FIG. 6 is a cross sectional view of the antenna.

With reference to FIGS. 4 and 5, the LAN antenna in this embodiment comprises an elliptical plate 1 made of conductors such as metals, a monopole 2 that is also made of conductors such as metals, and a printed board 3. The top of the monopole 2 is joined with the center of the elliptical plate 1.

The printed board 3 includes a conductive ground board 4 as an upper layer and a dielectric board 5 as a lower layer.

In addition, there is arranged a microstrip line 6 made of a conductor under the dielectric board 5. The ground board 4 is provided with a pattern clearance hole 7.

As can be seen in FIG. 6, the lower end of the monopole 2 extends through the pattern clearance hole 7 without touching the ground board 4, and is joined with the microstrip line 6 at a power supply point 8. The join is generally made by soldering or the like.

Incidentally, in FIGS. 4 to 6, the elliptical plate 1 is held in parallel relationship with the printed board 3 by way of example without limitation. The elliptical plate 1 can be adjusted at any angle to the printed board 3.

Figure 7:
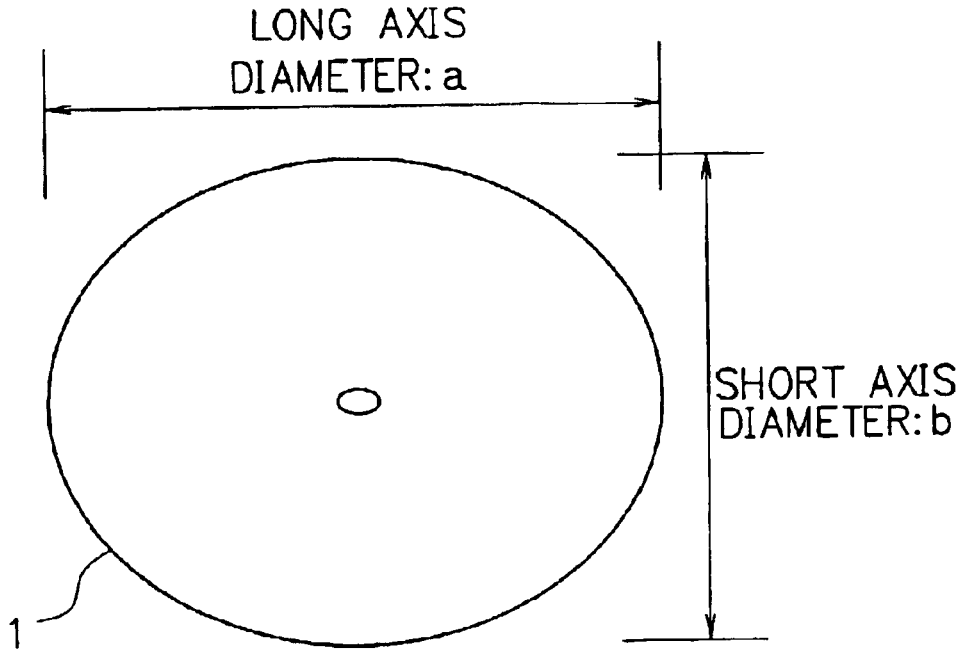
FIG. 7 is a diagram showing an elliptical plate used for the antenna element.

FIG. 7 is a diagram showing an example of the elliptical plate 1, in which a denotes the major axis and b denotes minor axis, namely, a>b.

Figure 8A:
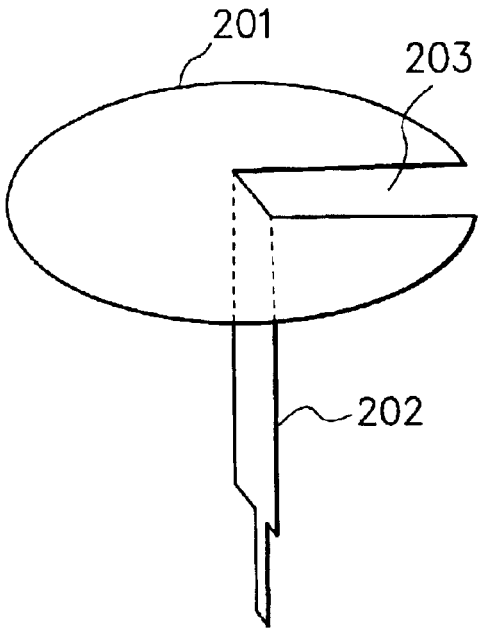
FIGS. 8(*a*) and 8(*b*) are perspective views showing partly the configuration of an antenna element according to the second embodiment of the present invention.
Figure 8B:
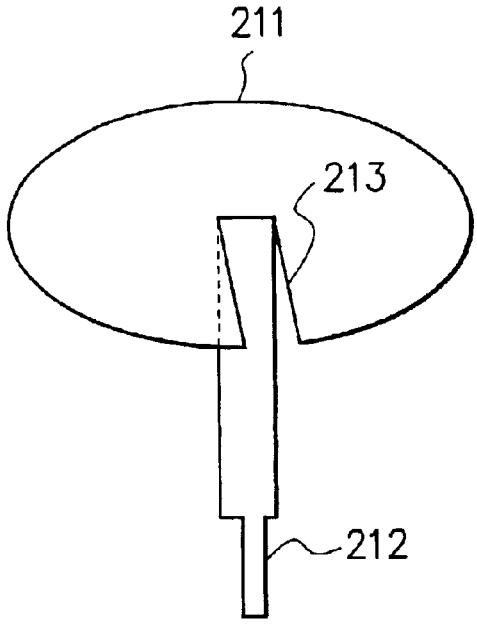

FIGS. 8(*a*) and 8(*b*) are perspective views showing the configuration of an elliptical plate and a monopole according to the second embodiment of the present invention. The elliptical plate 201 and monopole 202 are integrally formed from a conductive metal plate by means of bending the monopole 202 out of the plate, which creates a cutaway 203 in the elliptical plate 201. The elliptical plate 201 shown in FIG. 8(*a*) is provided with the cutaway 203 in a long axis direction. The elliptical plate 211 shown in FIG. 8(*b*) is provided with the cutaway 213 in a short axis direction.

In the configuration of the antenna as shown in FIG. 4, the elliptical plate 1 and monopole 2 are joined by soldering, or integrally formed by molding, cutting, etc. On the other hand, the antenna according to the second embodiment as shown in FIG. 8 is manufactured by just bending a steel plate once, which enables a drastic reduction of manufacturing costs.

Figure 9A:
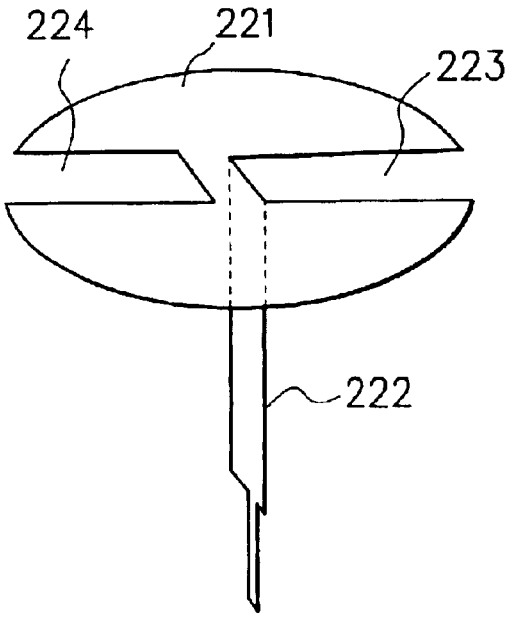
FIGS. 9(*a*) and 9(*b*) are perspective views showing partly the configuration of an antenna element according to the third embodiment of the present invention.
Figure 9B:
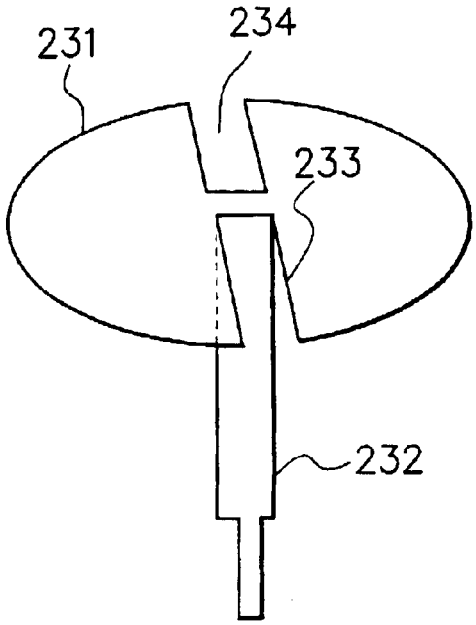

FIGS. 9(*a*) and 9(*b*) are perspective views showing the configuration of an elliptical plate and a monopole according to the third embodiment of the present invention. As is the case with the antenna according to the second embodiment shown in FIG. 8, the elliptical plate 221 and monopole 222 are formed from a conductive metal plate by means of bending the monopole 222 out of the plate, which creates a cutaway 223 in the elliptical plate 221. The elliptical plate 221 is further provided with a cutaway 224 differently from the elliptical plate 201 in FIG. 8.

In the configuration of the antenna as shown in FIG. 8, the currents in the elliptical plate 201 do not vectorially counteract each other to perfection since there is no current flow in the part of the cutaway 203. Consequently, the distribution of high-frequency currents in the elliptical plate 201 becomes asymmetrical, resulting in the emission of horizontal polarized wave components. The antenna in FIG. 8 is usable in the case where the purity of vertical polarized wave is not especially important and its cross polarized wave, namely, radiation having horizontal components make no difference. However, when it is necessary to repress the cross polarized wave or horizontal components, the antenna depicted in FIG. 9 is effective.

Referring to FIG. 9, the cutaway 224 is formed in a position symmetrical to the cutaway 223 so that the currents in the elliptical plate 221 vectorially counteract each other. Besides, the elliptical plate 221 is given an axisymmetrical shape to the extent possible. The cutaway 223 reaches almost the center of the elliptical plate 221, and therefore the cutaway 224 cannot be arranged strictly symmetrical to the cutaway 223. That is, the cutaway 224 does not reach the center of the elliptical plate 221, and is a little shorter than the cutaway 223. In this view, the elliptical plate 221 is perceived to assume a substantially axisymmetrical shape.

The elliptical plate 221 shown in FIG. 9(*a*) is provided with the cutaways 223 and 224 in a long axis direction. The elliptical plate 231 shown in FIG. 9(*b*) is provided with the cutaways 233 and 234 in a short axis direction.

As is described above, the cutaways 223, 224, 233 and 234 are formed so that the distribution of high-frequency currents in the elliptical plate becomes approximately symmetrical. Therefore, the cutaways are not necessarily formed along with a long axis or a short axis. In addition, there is no special limitation imposed upon the number of the cutaways.

Figure 10A:
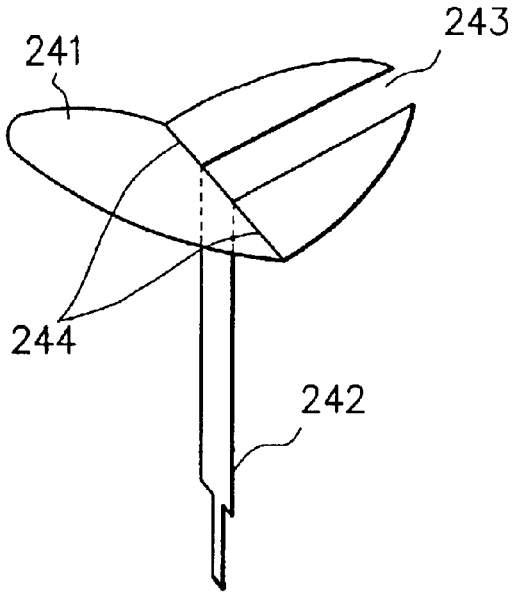
FIGS. 10(*a*) and 10(*b*) are perspective views showing partly the configuration of an antenna element according to the fourth embodiment of the present invention.
Figure 10B:
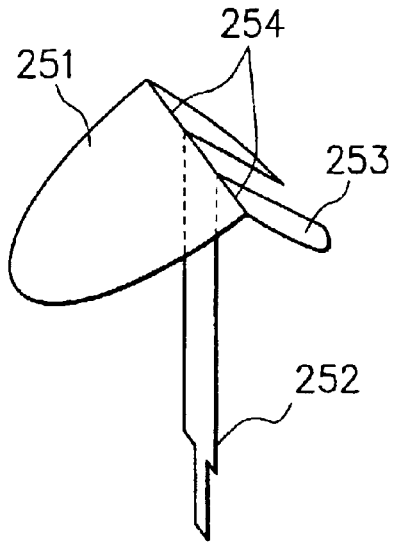

FIGS. 10(*a*) and 10(*b*) are perspective views showing the configuration of an elliptical plate and a monopole according to the fourth embodiment of the present invention. The elliptical plate 241 includes a fold 244 differently from the elliptical plate 201 in FIG. 8. The fold 244 adds the function of impedance control to the antenna. The input impedance of the antenna can be adjusted by bending the elliptical plate 241 at the fold 244. It does not matter if the elliptical plate 241 is bent up into a V-shape or bent down into an inverted V-shape. The elliptical plate 241 shown in FIG. 10(*a*) is provided with a cutaway 243 in a long axis direction and bent up into a V-shape at the fold 244. The elliptical plate 251 shown in FIG. 10(*b*) is also provided with a cutaway 253 in a long axis direction and bent down into an inverted V-shape at the fold 254. The cutaway and fold may be respectively formed in a short axis direction and a long axis direction.

Incidentally, in FIG. 10, the elliptical plate is bent into a V-shape or an inverted V-shape as is described above. However, the present invention is not to be limited to what is shown in the drawings and described in the specification. There are other various possible ways to bend the elliptical plate. For example, the elliptical plate may be bent at a different angle. Besides, the fold 244 is required at least to define a line at which the elliptical plate is bent. The line preferably passes through the point where one end of the monopole is joined to the elliptical plate or the vicinity thereof.

Figure 11A:
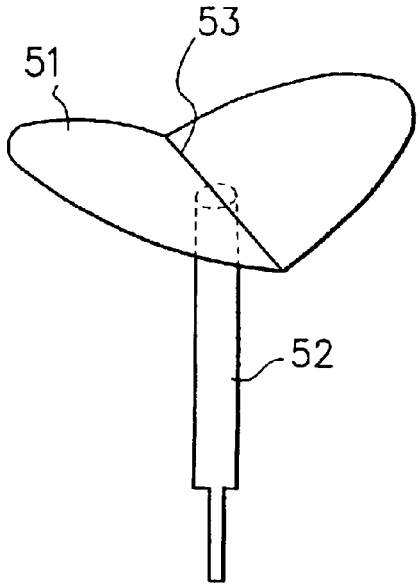
FIGS. 11(*a*) and 11(*b*) are perspective views showing partly the configuration of an antenna element according to the fifth embodiment of the present invention.
Figure 11B:
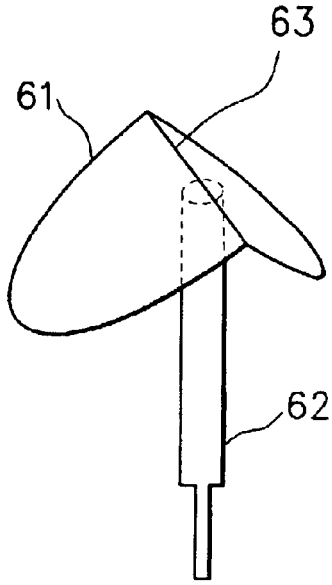
Figure 12A:
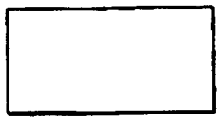
FIGS. 12(*a*) to 12(*e*) are diagrams showing examples of the shape of a top plate.
Figure 12B:
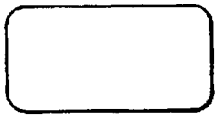
Figure 12C:
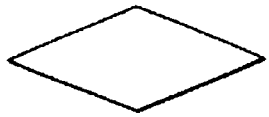
Figure 12D:
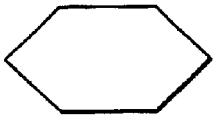
Figure 12E:
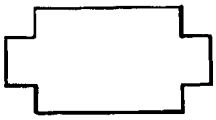

FIGS. 11(*a*) and 11(*b*) are perspective views showing the configuration of an elliptical plate and a monopole according to the fifth embodiment of the present invention. The elliptical plate 51 shown in FIG. 11 is provided with a fold 53, and not provided with cutaways differently from the elliptical plates shown in FIGS. 8 to 10. The elliptical plate 51 shown in FIG. 11(*a*) is provided with the fold 53 located at a right angle to a long axis (in a short axis direction). The elliptical plate 61 shown in FIG. 11(*b*) is provided with the fold 63 located at a right angle to a short axis.

The input impedance of the antenna can be adjusted by bending the elliptical plate at the fold as shown in FIGS. 10 and 11. The manufacturers of wireless LAN hard ware that includes antenna part generally carry out adjustments for characteristics of the RF section or transmission/reception amplifiers. The adjustments are not omissible in the present techniques.

In equipment having the integrated combination of the antenna and RF circuit such as a wireless LAN card, it is impossible to make individual adjustments, namely, impossible to adjust the antenna and RF circuit separately because connectors for a characteristic check are not exposed due to the integration. If there is a part used for performing final adjustments in antenna part as well as in the RF section, productivity can be improved. In other words, it is inevitable that individually different panels come into the production line. If, however, receiving sensitivity is improved by fine adjustment in antenna part, or antennas that do not meet the specifications are made acceptable by such adjustment, the direct first run rate (yield ratio) can be improved.

As is described above, the adjustment in antenna part is implemented by bending the elliptical plate at the fold as shown in FIGS. 10 and 11. This is because the elliptical plate has electric capacitance on the basis of the ground board. The electric capacitance is changed by bending the elliptical plate at the fold, which enables fine adjustment for input impedance and resonance frequency of the antenna.

While a description has been given of the case where the elliptical plate is adopted for the antenna, the shape of the top plate can be selected from various alternatives. FIGS. 12(*a*) to 12(*e*) are diagrams showing examples of other shapes for the top plate. The top plate of these shapes is available instead of the elliptical plate 1 depicted in FIG. 4. The top plate is basically required to be symmetrical with respect to two orthogonal axes which are perpendicular to the thickness of the top plate and passing through the center of the area of the top plate, in which the lengths of the axes are different from each other. FIG. 12(*a*) is a diagram showing the top plate 301 in a rectangle shape. FIG. 12(*b*) is a diagram showing the top plate 302 having a rectangle shape, angles of which are rounded off FIG. 12(*c*) is a diagram showing the top plate 303 in a rhombus shape. FIG. 12(*d*) is a diagram showing the top plate 304 in a hexagon shape. FIG. 12(*e*) is a diagram showing the top plate 305 in a dodecagon shape. The angles of polygons other than the rectangle shown in FIG. 12(*b*) may also be rounded off. Further, part of the angles of each polygon may be selectively rounded off.

Figure 14:
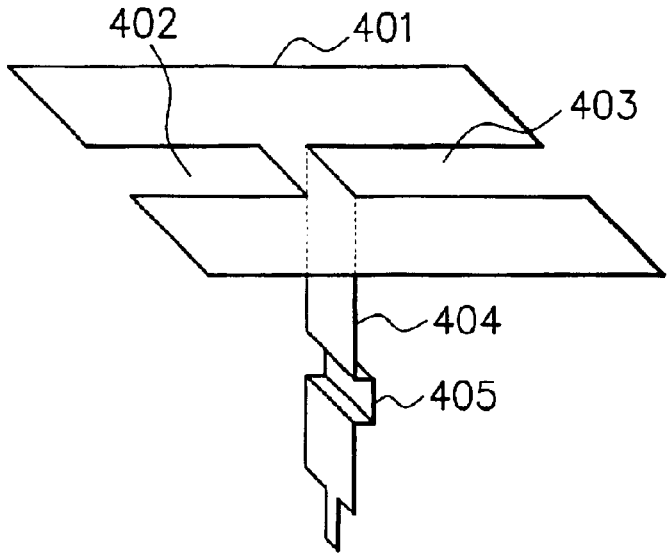
FIG. 14 is a perspective view showing partly the configuration of an antenna element according to the sixth embodiment of the present invention.

FIG. 14 is a perspective view showing the configuration of a top plate and a monopole according to the sixth embodiment of the present invention. The monopole 404 has a bend part 405 partway along its length. The top plate 401 assumes the shape of rectangle shown in FIG. 12(*a*). The top plate 401 includes cutaways 402 and 403 formed along with a long axis. Basically, the bend part 405 is provided for the purpose of fine adjustment of input impedance and resonance frequency of the antenna.

The bend part 405 includes four ninety (90°)-bends. The fine adjustment of input impedance and resonance frequency is implemented by bending these bends rather sharply or gently. To be more precise, when pressing down or lifting up the top plate 401, the distance between the top plate 401 and ground board is changed. Consequently, electric capacitance between them is also changed, and thereby the aforementioned adjustment can be carried out.

Figure 13A:
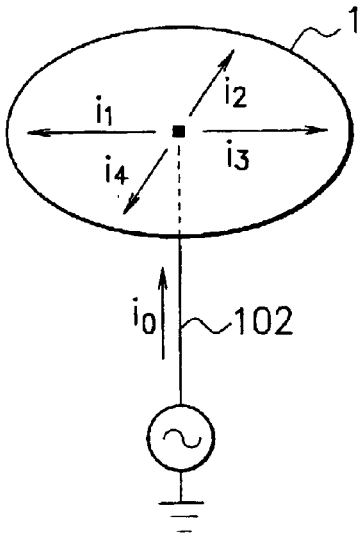
FIGS. 13(*a*) to 13(*c*) are diagrams showing the current distribution of the antenna element depicted in FIG. 4.
Figure 13B:
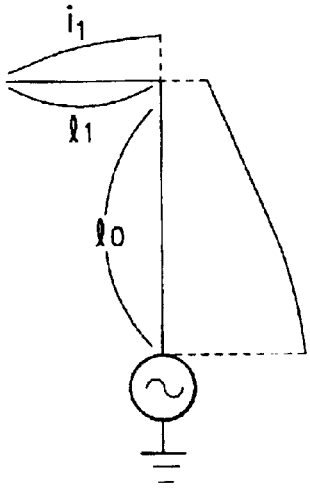
Figure 13C:
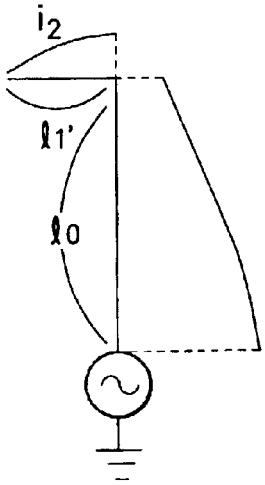

FIGS. 13(*a*) to 13(*c*) are diagrams showing the current distribution of the antenna element depicted in FIG. 4. In the following, the principle of electrical operation of a LAN antenna according to the present invention will be explained with reference to FIG. 13. The LAN antenna of the present invention is provided with the elliptical plate 1 as a top plate instead of using a circular plate. Accordingly, in FIG. 13(*a*), currents $i_1$ and $i_2$ in the elliptical plate 1 flow different distances. The different flow distances lead to different values of resonant wavelength as shown in FIGS. 13(*b*) and 13(*c*). That is, currents $i_0$ and $i_1$ provide a resonant wavelength corresponding to the wavelength resulting from the current running through the length of $l_0$ and $l_i$ as shown in FIG. 13(*b*). On the other hand, currents $i_0$ and $i_2$ provide a resonant wavelength corresponding to the wavelength resulting from the current running through the length of $l_0$ and $l_1$ as shown in FIG. 13(*b*).

While the currents $i_1$ and $i_2$ represent the currents running in a long axis direction and a short axis direction in the elliptical plate 1, respectively, there are numerous currents running in all directions. Consequently, the antenna resonates at numbers of wavelengths, which gives the antenna higher bandwidth capability.

Incidentally, in FIG. 13(*a*), radiations from the currents $i_1$ and $i_3$ vectorially counteract each other. Much the same is true on the currents $i_2$ and $i_4$. Consequently, there is no field emission in a horizontal plane, and therefore the purity of vertical polarized wave is assured. The effective top plate other than the elliptical plate 1 has a shape symmetrical with respect to two orthogonal axes which are perpendicular to the thickness of the top plate and passing through the center of the area of the top plate, in which the lengths of the axes are different from each other. For example, a conductor having a shape selected from the polygons illustrated in FIGS. 12(*a*) to 12(*e*) is usable.

Figure 3:
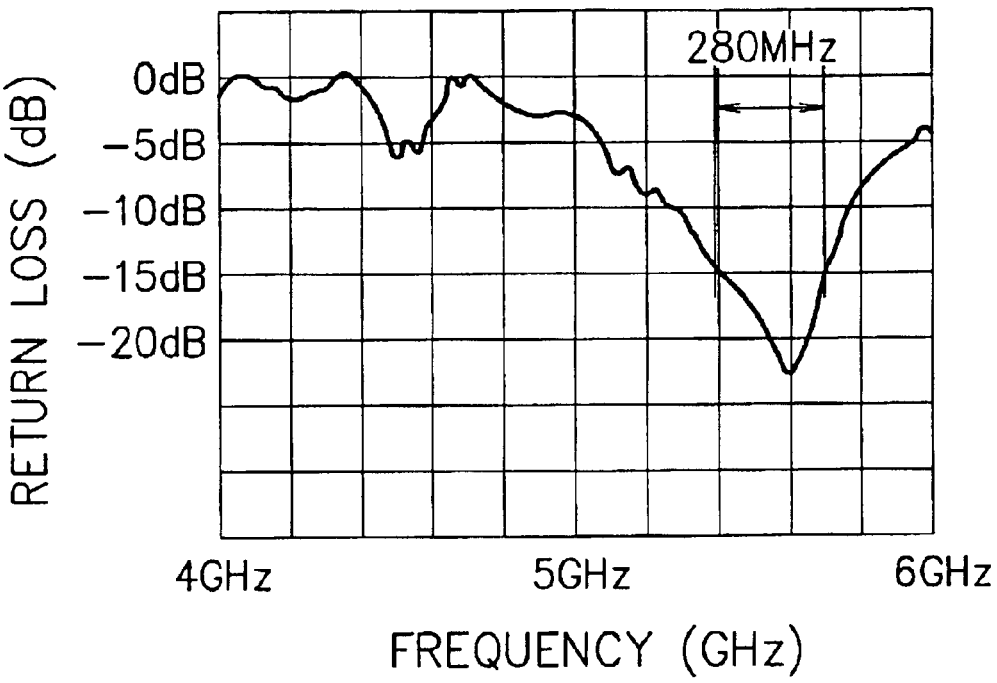
FIG. 3 PRIOR ART
FIG. 3 is a graph showing the return loss characteristics of the antenna element depicted in FIG. 1.

Below is a comparison of the frequency ranges of the conventional antenna and the antenna according to the present invention. As is described previously in connection with FIG. 3, the conventional antenna is operational in a bandwidth of 280 MHz, which constitutes about 5.1% of the frequency spectrum.

Figure 15:
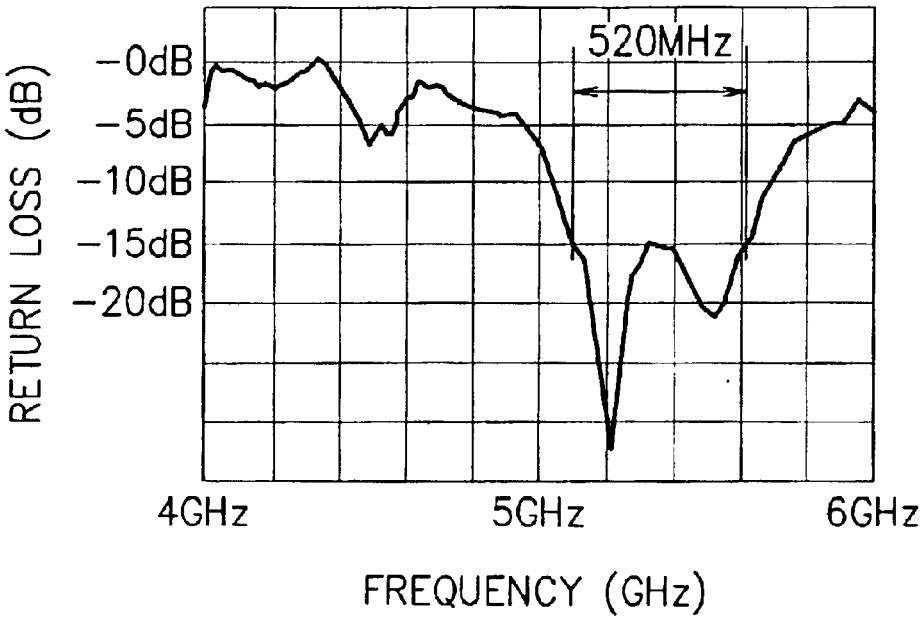
FIG. 15 is a graph showing the return loss characteristics of the antenna element depicted in FIG. 4.

FIG. 15 is a graph showing the return loss of the LAN antenna of the present invention by actual measurement. The LAN antenna has the configuration illustrated in FIG. 4. The major axis of the elliptical plate is approximately 9 mm. The minor axis is approximately 6 mm. The distance between the elliptical plate and the upper surface of the printed board, that is, the length of the monopole except for the part inserted in the printed board is 5.5 mm. In addition, the microstrip line is arbitrarily provided with stubs thereon to carry out adjustment of return loss characteristics as in the case of FIG. 3. Referring to FIG. 15, the LAN antenna is operational in a bandwidth of 520 MHz, which constitutes about 9.8% of the frequency spectrum. Thus, the LAN antenna can assure a nearly doubled width of band as compared to the conventional antenna.

The preferred embodiments of the antenna according to the present invention have been described hereinbefore. The antenna of the present invention can be configured by any combination of these embodiments. For example, the top plate of the antenna may have the shape of rhombus, include one or more cutaways and a fold along with a prescribed axis thereon, and bent up into a V-shape at the fold.

While the present invention has been described with reference to the particular illustrative embodiments, it is not to be restricted by the embodiments but only by the appended claims. It is to be appreciated that those skilled in the art can change or modify the embodiment without departing from the scope and spirit of the present invention.

What is claimed is:

1. An antenna element comprising:

a top plate;

a printed board; and a monopole that is joined with the top plate at one end and with the printed board at the other end to hold the top plate in a fixed posture toward the printed board;

wherein the top plate is symmetrical with respect to two orthogonal axes which are perpendicular to the thickness of the top plate and passing through the center of the area of the top plate;

wherein the lengths of the axes are different from each other; and wherein the top plate is bent, along a bend axis running across the top plate, into one of a V-shape and an inverted V-shape.

2. The antenna element claimed in claim 1, wherein the top plate has an elliptical shape.

3. The antenna element claimed in claim 1, wherein the monopole is provided with a bend part which is bent out of the plane of the monopole to form a recess configured to expand or contract to facilitate fine adjustment of an input impedance and a resonance frequency of the antenna element.

4. An antenna element comprising:

a top plate;

a printed board; and a monopole that is joined with the top plate at one end and with the printed board at the other end to hold the top plate in a fixed posture toward the printed board;

wherein the top plate is integrally formed with the monopole from a flat plate;

wherein the top plate is symmetrical with respect to two orthogonal axes which are perpendicular to the thickness of the top plate and pass through the center of the area of the top plate;

wherein the lengths of the axes are different from each other;

wherein the top plate and the monopole are formed by means of bending the monopole out of the flat plate;

wherein the monopole-bending creates a cutaway in the flat plate; and wherein the top plate is bent, along a bend axis running across the top plate, into one of a V-shape and an inverted V-shape.

5. The antenna element claimed in claim 4, wherein the top plate has an elliptical shape.

6. The antenna element claimed in claim 4, wherein the monopole is provided with a bend part which is bent out of the plane of the monopole to form a recess configured to expand or contract to facilitate fine adjustment of an input impedance and a resonance frequency of the antenna element.

7. An antenna element comprising:

a top plate;

a printed board; and a monopole that is joined with the top plate at one end and with the printed board at the other end to hold the top plate in a fixed posture toward the printed board;

wherein the top plate is integrally formed with the monopole from a flat plate;

wherein the top plate and the monopole are formed by means of bending the monopole out of the flat plate;

wherein the monopole-bending creates a cutaway in the flat plate;

wherein another cutaway is provided in the flat plate;

wherein the top plate is symmetrical with respect to an axis which is perpendicular to the thickness of the top plate and runs longitudinally of the cutaways through the center of the area of the top plate, and substantially symmetrical with respect to an axis running through the center of the longitudinal axis at right angles thereto;

wherein the lengths of the longitudinal axis and the axis running at right angles thereto are different from each other; and wherein the top plate is bent, along a bend axis running across the top plate, into one of a V-shape and an inverted V-shape.

8. The antenna element claimed in claim, 7 wherein the monopole is provided with a bend part which is bent out of the plane of the monopole to form a recess configured to expand or contract to facilitate fine adjustment of an input impedance and a resonance frequency of the antenna element.

9. An antenna element comprising:

a top plate;

a printed board; and a monopole that is joined with the top plate at one end and with the printed board at the other end in as to hold the top plate in a fixed posture toward the printed board;

wherein the top plate is integrally formed with the monopole from a flat plate;

wherein the top plate is symmetrical with respect to two orthogonal axes which are perpendicular to the thickness of the top plate and pass through the center of the area of the top plate;

wherein the lengths of the axes are different from each other;

wherein the top plate and the monopole are formed by means of bending the monopole out of the flat plate;

wherein the monopole-bending creates a cutaway in the flat plate;

wherein the cutaway is formed longitudinally or transversely of the top plate; and wherein the top plate is bent, along a bend axis running across the top plate, into one of a V-shape and an inverted V-shape.

10. The antenna element claimed in claim 9, wherein the monopole is provided with a bend part which is bent out of the plane of the monopole to form a recess configured to expand or contract to facilitate fine adjustment of an input impedance and a resonance frequency of the antenna element.

11. An antenna element comprising:

a top plate;

a printed board; and a monopole that is joined with the top plate at one end and with the printed board at the other end to hold the top plate in a fixed posture toward the printed board;

wherein the top plate is integrally formed with the monopole from a flat plate;

wherein the top plate and the monopole are formed by means of bending the monopole out of the flat plate;

wherein the monopole-bending creates a cutaway in the flat plate;

wherein another cutaway is provided in the flat plate;

wherein the cutaways are formed longitudinally or transversely of the top plate;

wherein the top plate is symmetrical with respect to an axis which is perpendicular to the thickness of the top plate and runs longitudinally of the cutaways through the center of the area of the top plate, and substantially symmetrical with respect to an axis running through the center of the longitudinal axis at right angles thereto;

wherein the lengths of the longitudinal axis and the axis running at right angles thereto are different from each other; and wherein the top plate is bent, along a bend axis running across the top plate, into one of a V-shape and an inverted V-shape.

* * * * *